United States Patent [19]

Lloveras-Capilla

[11] Patent Number: 5,071,343

[45] Date of Patent: Dec. 10, 1991

[54] LIQUIFIED GAS LIGHTER

[75] Inventor: Xavier Lloveras-Capilla, Sant Vicenc de Montalt, Spain

[73] Assignee: Sandaco, S.A., Barcelona, Spain

[21] Appl. No.: 520,135

[22] Filed: May 7, 1990

Related U.S. Application Data

[63] Continuation of Ser. No. 249,892, Sep. 27, 1988, abandoned.

[30] Foreign Application Priority Data

Oct. 15, 1987 [ES] Spain ..... 8702942

[51] Int. Cl.[5] ..... F23D 14/28; F15D 1/02

[52] U.S. Cl. ..... 431/344; 431/206; 431/207; 138/40; 138/44; 222/3; 222/564

[58] Field of Search ..... 431/142, 143, 144, 241, 431/344, 243, 206, 207; 222/3, 346, 564; 138/44, 40

[56] References Cited

U.S. PATENT DOCUMENTS

| | | | |
|---|---|---|---|
| 2,418,671 | 4/1947 | Schweller | 138/40 X |
| 2,423,155 | 7/1947 | Phillips | 138/40 |
| 2,652,707 | 9/1953 | Reilly, Jr. et al. | 222/3 X |
| 2,774,235 | 12/1956 | Ruetz | 431/206 X |
| 3,148.521 | 9/1964 | Zellweger | 222/3 X |
| 3,152,460 | 10/1964 | Piffath | 431/142 X |
| 3,190,088 | 6/1965 | Kitabayashi | 431/207 |
| 3,286,491 | 11/1966 | Smith | 222/3 X |
| 3,292,396 | 12/1966 | Zellweger et al. | 222/3 X |
| 4,496,309 | 1/1985 | Schachter | 431/344 |
| 4,506,423 | 3/1985 | Nakamura et al. | 138/42 X |

FOREIGN PATENT DOCUMENTS

| | | |
|---|---|---|
| 2450418 | 9/1980 | France . |
| 2613638 | 10/1988 | France . |

*Primary Examiner*—Carl D. Price

*Attorney, Agent, or Firm*—Scully, Scott, Murphy & Presser

[57] ABSTRACT

A lighter having a body bounding a liquefied gas reservoir and an exhaust chimney through which the gas issues to the outside when a lid is opened. The lighter has a gas rate-of-flow limiter in the form of a tube of a length greater than 5 mm and of a very reduced flow cross-section between 0.03 and 0.002 mm. The tube is disposed in the reservoir and is fitted hermetically in the body either directly or with the interposition of a support member.

12 Claims, 2 Drawing Sheets

LIQUIFIED GAS LIGHTER

This application is a continuation of application Ser. No. 249,892, filed 9/27/88 now abandoned.

BACKGROUND OF THE INVENTION

This invention relates to a liquefied gas lighter having a frame or body devised with a reservoir for liquefied gas; an exhaust chimney, it being possible for a gas flow to arise between the reservoir and the chimney; flow shut-off means comprising a lid, a non-variable rate-of-flow limiter; and means for guiding the flow from inside the reservoir to the flow shut-off means.

DESCRIPTION OF THE PRIOR ART

In conventional lighters the very complexity of the assembly process and the spread of properties of the raw materials lead to variations in the rate of gas flow and, therefore, to departures from the required flame height. Temperature too has an effect for by varying the pressure of the gas in the reservoir temperature changes alter flame height from the factory values, often with the result of exceeding safe limits for the user or rational limits for the operation of the lighter. Many countries have a statutory limit on flame height and the ASTM RECOMMENDATION in Standard F-400-85 (November 1985) is customarily used.

The last generation of lighters (without rate-of-flow control means) limit flow by the use of microporous diaphragms (almost exclusively in lighters of the "Celgard" make, types 2400 and 2500), suffer from the defects just mentioned and also have manipulation difficulties in assembly because of the fragility of the microporous diaphragm and the fact that it becomes unstable with use because of its inconsistency (thickness of 0.025 mm and tearing strength of 1.4 kg/mm$^2$) and because its properties vary with temperature. The phenomenon of high flames which are dangerous to the user after the lighter has been dropped is typical and is due to the diaphragm being ruptured by a water-hammer blow from the mass of liquefied gas at the instant of impact.

A conventional solution of the problem is to provide lighters with variable means for limiting the rate of gas flow; unfortunately, this solution increases product price and in any case enables flame height to be adjusted only after the unwanted effects thereof have been observed.

It is known that some gas lighters limit gas flow by means of the adjustable compression of fibrous sheets or sponges (U.S. Pat. No. 1 737 037) or by the use of microporous diaphragms (FR-P-2 613 638 and U.S. Pat. No. 4 496 309) and by the use of materials sintered or compacted by a special process (FR-P-2 450 418). All these steps proceed from a common basis. Since it was previously impossible to obtain in an industrial process a gauge or standard in the form of a single calibrated aperture of very reduced cross-section and of dimensions making it industrially feasible, the various cited technologies resort to placing one above another a large number of flow channels whose individual hydrodynamic properties are unknown but whose properties overall—i.e., integrated over a given flow area or surface—are adapted (with an inevitable spread inherent in the very statistical concept of the system) to average values appropriate for use in lighters. The flow cross-section concept has therefore introduced a new variation factor in the rate of flow since such section must be embodied and is therefore subject to the variations and deviations inherent in the process of manufacturing it.

All the technologies for producing the flow restricting elements mentioned are complex and the products of the process are often beyond the limits of tolerance, only a narrow fringe of the entire production being usable. The microporous diaphragms experience microdetachments by two-directional drawing in a controlled temperature rolling process, an extremely thin film being the essential end product to ensure adequate porosity, with handling and after-processing difficulties which can readily be imagined. After some use the porosity of the sintered flow restrictor elements is very below what is normal for components used in this art, such as filters and separators, and the process for producing them is very complicated and difficult.

SUMMARY OF THE INVENTION

It is the object of the invention to provide a lighter which obviates the disadvantages mentioned and provides a rate of flow of improved constancy.

Surprisingly, this is achieved with a lighter of the kind hereinbefore set out wherein the flow limiter and the flow shut-off means are embodied by a single tube which is more than 5 mm long and which has at least one longitudinal passage with a total flow cross-section, including the sum of the flow cross-sections of all such passages, between 0.03 and 0.002 mm$^2$, the tube being a hermetic fit in the lighter body either directly or with the interposition of a support member.

The limiter tube makes the lighter more reliable and practical than conventional lighters since the lighter according to the invention is more rugged and has a less dispersed gas flow, which is also more stable in respect of temperature variations. Cost is also reduced considerably since the components are cheaper and assembly is simpler.

BRIEF DESCRIPTION OF THE DRAWINGS

Other advantages and features of the lighter according to this invention will be described hereinafter with reference to preferred embodiments. The description is not limitative and makes reference to the accompanying drawings wherein.

DESCRIPTION OF THE PREFERRED EMBODIMENTS

Figure 2:
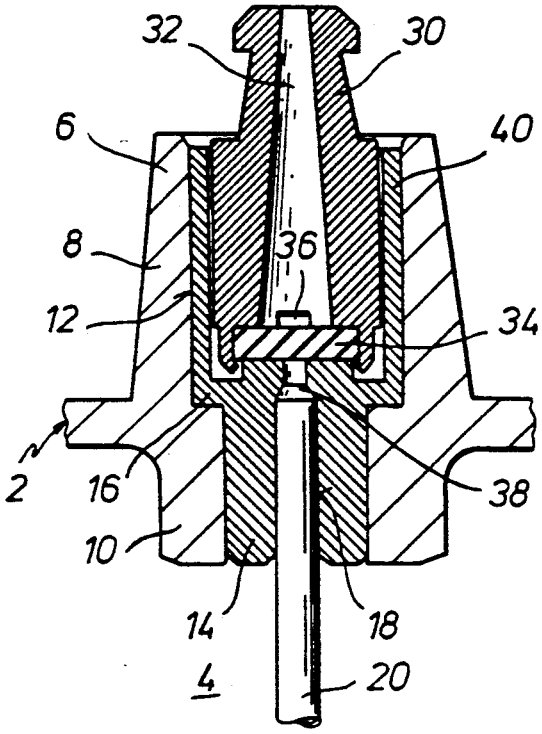
FIG. 2 is a view similar to FIG. 1 of another embodiment.

The lighter comprises a body 2; only those parts thereof which are contiguous with the valve are shown. With regard to FIGS. 1 and 2, the body 2 is to be understood as extending downwardly and merging into a reservoir 4 for liquefied gas.

The body 2 also comprises a tubular part 6 having a projecting part 8 and a part 10, the latter being introduced into the reservoir 4. The tubular part 6 is preferably cylindrical and is formed with a continuous longitudinal passage 12 which may or may not have parts of different diameters. The tubular part 6 receives the valve formed by chimney 30 and lid 34, as described below; when the same opens combustible gas flows from the reservoir 4 and the terms "upstream" and "downstream" will be used hereinafter to denote the direction towards the reservoir 4 and the opposite direction, respectively.

Preferably, a support member 14 is engaged hermetically at least in part 10 of tubular part 6 and preferably has a lateral widening 16 disposed immediately above the part 10.

The support member 14 is formed with a passage 18 in which a tube 20 is received hermetically by means of a socket based on minor differences between passage diameter and tube diameter or by means of any other system ensuring the immobility and hermeticity of the connection, such as flanging, sticking with adhesive or the like. Preferably, the tube 20 is engaged in the passage 18 over a length of from 3 to 5 mm.

According to another feature of the invention, the tube 20 is inserted directly in the body 2, in which case the body 2 is formed with a passage similar to the passage 18.

The tube 20 is a means for guiding the flow of the gas contained in the reservoir 4 and is also operative as a means for limiting the rate of such flow.

The tube 20 is longer than 5 mm and preferably extends to near the base (not shown) of the reservoir 4. Preferably, it is formed with a single longitudinal passage 22; however, a number of independent passages 22*a*, 22*b*, 22*c* can be provided and the total passage or flow cross-section (where applicable, as the result of the sum of the flow cross-sections of each independent passage) is very reduced, being between 0.03 and 0.002 $mm^2$ depending on the shape of the cross-section chosen and on other parameters. The tube is in its outer shape substantially cylindrical and its external diameter is preferably between 0.5 and 1 mm. The flow cross-section of each of the passages 22 is substantially constant throughout tube length and is of a known and predetermined dimension depending upon the required flow limitation.

The tube 20 is made of a material having satisfactory chemical, thermal and dimensional stability and being appropriate for the process for producing the tube. An acetal homopolymer meets these requirements.

Preferably, the passages 22 have configurations with a high perimeter-to-area ratio in the cross-section. Passages are therefore provided having longitudinal surfaces 24 so disposed substantially opposite one another as to bound very narrow gaps between the oppositely disposed surfaces 24, leaving small cracks or chinks which in some cases have a labyrinth configuration. The cross-sections shown in FIGS. 3*a*–3*f* are examples of different passage cross-section geometries which are useful for flow limitation. These special configurations will be referred to hereinafter when load losses are being discussed.

The tubes 20 are produced by extrusion with dimensions several times greater than those of the end product, the difficulty of the process being similar to the difficulty of producing any tube. Upon leaving the extruder, with the material still plastic and in a process similar to the process for producing textile fibres, the extruded tube is drawn, and outer diameter and inner flow cross-section both being reduced. After cooling all that remains is to part off this continuously produced tube to the required length. The variations in rate of flow between tubes having the same internal shape and the same length and produced by this process and tested with the fuels for the lighters mentioned in normal conditions is less than ±4% of the average value without need for further adjustment.

Disposed in the projecting part 8 of the tubular part 6 is an exhaust chimney 30 which has a clearance of approximately 0.1 mm from the element extending around it. The chimney 30 can be moved longitudinally between a first maximum-insertion position, corresponding to the valve being in the closed state, and a second position (not shown) into which it can be moved with the use of actuating means which tend to maintain the chimney in its first position. Such means are conventional and therefore not shown.

The chimney 30 has an axial inner duct 32 through which the gas can escape to atmosphere and the gas reaches the duct 32 through slots 36. Connected to the chimney 30 is a shutoff device comprising a lid 34, preferably in the shape of a disc which can be made of a low-hardness elastomer (a Shore hardness of approximately 70) and which is of proven chemical and thermal stability, such as an acrylonitrile butadiene. The top end of the tube 20 and the lid 34 co-operate to bound a chamber 38.

Figure 1:
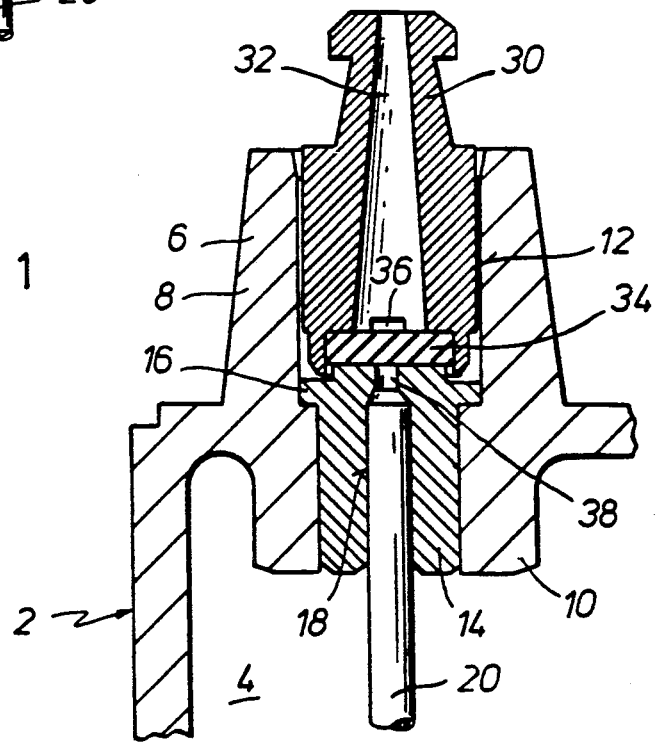
FIG. 1 is an axial section through the valve of a liquefied gas lighter, the section being through the lighter body and the limiter tube.
Figure 3A:
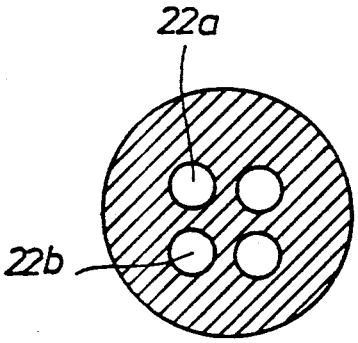
FIGS. 3*a*–3*f* show examples of cross-sections of the tube.
Figure 3B:
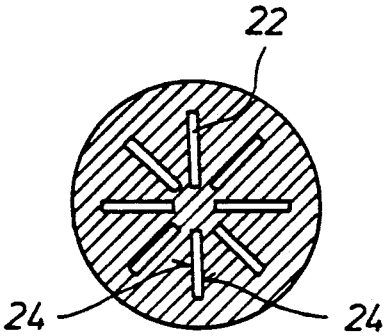
Figure 3C:
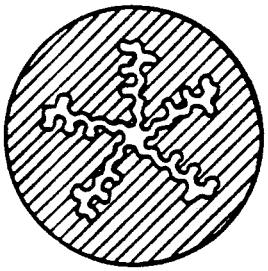
Figure 3D:
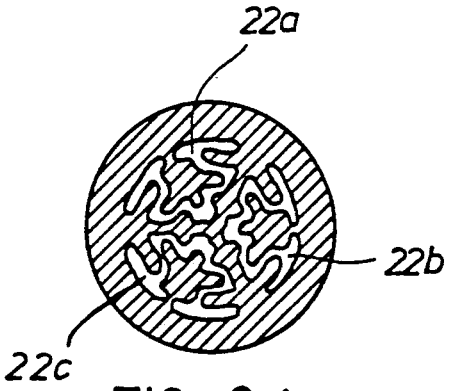
Figure 3E:
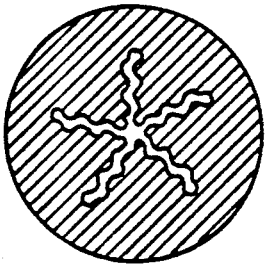
Figure 3F:
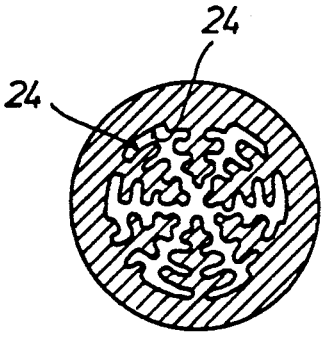

In a first embodiment shown in FIG. 1 the support member is not subject to restrictions concerning heat conductivity or specific heat since the fuel arriving through the flow-limiter tube 20 is in gas form and, having been evaporated in the liquid body of the reservoir 4, requires no further supply of heat. The support member 14 can therefore be made of brass or aluminium or zinc alloys and preferably of plastics, such as an acetal homopolymer, which is the most suitable because it has the same coefficients of heat expansion as the tube 20. In this arrangement the lighter operates in the gas phase and nothing but vaporized fuel flows through the tube 20. To this end some changes must be made to the surface molecular structure of the material used for the tube 20, typically a silanization (for example, with 1,1,1,3,3,3-hexamethyldisilazane) or a treatment with silicones or fluorinated compounds which stick to the material of the tube 20 so that the same has a lipophobic behaviour—i.e., it prevents the column of liquefied gas from rising and therefore makes it necessary for the fuel to be vaporized in the body of liquid.

In the embodiment shown in FIG. 2 the support member 14 has a prolongation 40 which is coaxial with a longitudinal part of the chimney 30, a reduced radial gap being present between the prolongation 40 and such part of the chimney 30. The prolongation 40 is of dished shape and extends around the outside of the corresponding part of the chimney 30.

In this embodiment the support member 14 is preferably made of metal, such as brass or aluminium or a zinc alloy, or of any other material which is a good conductor and storer of heat so as to ensure ready evaporation of the liquid fuel rising through the tube 20. The heat is yielded in the time immediately after opening of the shutoff device from the specific heat stored in mass form in the support member 14 and subsequently from the heat which is yielded by the flame and which is conveyed by radiation and conduction through the chimney 30 and the support member prolongation 40. The support member 40 can be produced by machining or stamping or injection and should have a minimum mass such as to provide a specific heat availability of 0.15 Joules/° C.

Also, the chamber 38 should be of reduced dimensions to boost turbulence, which boosts heat exchange and prevents any excessive accumulation of fuel briefly consumed right at the start of ignition. This ensures that overflaming due to accumulation at the start of ignition is imperceptible. In this embodiment the lighter operates in the liquid phase and the limiter tube 20 supplies liquefied gas.

In this liquid phase embodiment the exhaust chimney 30 should be made of a material which is a good conductor of heat, such as zinc alloy.

As previously stated, the support member 14 is in sealing-tight engagement with the tubular part 6, to which end the outside surface of the member 14 is suitable to ensure anchorage thereof in the tubular part 6 with complete sealing-tightness and with the ability to withstand the internal pressure of the liquefied gas without movement. In the embodiment of FIG. 2 the outside surface of the prolongation 40 has similar characteristics to the outside surface of the support member 14 to ensure an appropriate fit in the inside surface of the projecting part 8 of the tubular part 6.

The liquefied gas conventionally used as lighter fuel is isobutane or as a substitute a mixture of linear hydrocarbons (n-propane, n-butane and isobutane) which are volatile at ambient temperature and which have properties similar to those of isobutane. At 23° C. isobutane has a relative vapor pressure of 3.25 bar (0.325 mPa). At temperatures above and below 23° C., which can also be ambient temperatures, the vapor pressure is respectively above or below 3.25 bar and the lighter must still deliver a functional flame. Since the pressure at the downstream end of the chamber 38 must be only slightly greater than atmospheric pressure (to ensure normal flame height) the pressure drop between the upstream end and downstream end of the limiter tube 20 must be substantially the pressure difference between the pressure in the reservoir 4 and atmospheric pressure. Consequently, to produce a substantially constant flame height independent of temperature of use, the rate of gas flow through the tube 20 must be as independent as possible of the pressure in the reservoir 4, which is the pressure of the liquefied gas vapor at each temperature.

The pressure drop process in the longitudinal passage 22 of the tube 20 is complex and depends upon the geometry of the flow cross-section of each longitudinal passage 22.

As a rule, and irrespective of cross-sectional shape, a turbulent flow is preferred to a laminar flow since in the case of a turbulent flow pressure losses increase exponentially with the average flow velocity (which for a given cross-section is equivalent to the rate of flow and also to flame height), whereas in the case of laminar flow this increase is only linear. When the lighter operates in the gas phase and the flow limiter is supplied with a normal flow, typically 1.2 mg/sec, operation is always in turbulent conditions irrespective of flow cross-section geometry, with a rate of flow of some 75 m/s and a Reynolds number which is always greater than that of a laminar flow. When the lighter operates in the liquid phase special steps are necessary to produce a turbulent flow. In liquid phase operation the viscous resistances of the liquefied gas are much greater (due to increased internal cohesion of the molecules of the fluid) and this phenomenon can be increased by increasing the perimeter of the flow cross-section (not altering the size of cross-section), so that a boundary layer situation is entered and there is a change from a parabolic velocity distribution to a distribution of the movement of flat sheets in the body of a fluid, with much greater load losses due to viscosity.

As previously stated, the preferred flow cross-sections are those corresponding to geometries such as are shown in FIGS. *3a–3f*. If the inner cross-section of the longitudinal passage of the tube 20 is circular, the relationship of mass flows between, on the one hand, operation of the lighter in the liquid phase and, in the same conditions of pressure and temperature, in the gas phase, is 15 times.

Contrarily, when the longitudinal passages have longitudinal surfaces 24 disposed opposite one another with very narrow between-surfaces gaps—i.e., when the passages have the configurations shown—the rates of flow in both forms of operation—i.e., liquid phase and gas phase—can be substantially equalized.

Also, in the conditions set out in the preceding paragraph variations in rate of flow in dependence upon pressure variations are slight. For end pressure situations such as 2 bars and 5 bars, the basic rates of flow and, therefore, flame heights differ by less than 20% from the 3.25 bar rate of flow, as compared with the figure of more than 100% for conventional known lighters.

The choice of this optimal geometry for the flow cross-section takes into account in addition to the considerations hereinbefore set out stability phenomena of the boundary layer (L. PRANDTL Results Aerodynamic Tests Institute, Göttingen, III Lieferung, 1927 and H. L. LANGHAAR Steady Flow in the transition length of a straight tube J. Appl Mech. Vol. 9 pp. 55–58, 1942) and thermodynamic phenomena due to expansion of the fluid and change of phase, these items being complicated to describe and making it impossible to give a general defining parameter for optimal geometry such as a ratio of perimeter to flow section area.

In view of the substantial lateral area of the longitudinal passage of the flow-limiter tube 20 as compared with the known devices and since such tube is almost completely submerged in the liquefied gas reservoir (which is a relatively very large thermal mass), in a normal configuration (for example, tube outer diameter of 0.8 mm, tube length of 50 mm and side wall thickness of 0.25 mm) sufficient heat (0.1 cal/sec) can be supplied to fully vaporize the liquefied gas flow (at a typical rate of 1.2 mg/sec), for liquid phase operation in the limiter tube, by convection and conduction from the liquid mass to the limiter device (0.2 cal/sec for a heat jump of 15° C.) and residual quantities by specific heat or the conversion into heat of the energy arising from fluid flow load loss. Consequently, even when the tube 20 is supplied in the liquid phase and vaporization occurs while the fluid is flowing through the tube, it reaches the downstream end of the vaporization chamber 38 in vapor form and since no further supply of heat is needed a support member 14 and a chimney 30 which are not good heat conductors can be used.

As previously stated, the mass flow spread for given conditions of supply is within ±4% of the average value. These variations produce negligible alterations in flame height (±1 mm for a normal 20 mm flame). If a more uniform rate of flow is required, a first parting-off is provided at delivery from the extruder at a length slightly greater than the theoretical length and subsequently (before or after insertion of the limiter tube 20 in the support member 14) and before the assembly is placed in the lighter a rate of flow reading is taken on the basis of a supply of air or some other known fluid at a known pressure, whereafter in dependence upon the result of the reading a second adjusting cut is made so that the rate-of-flow spread is reduced to that associated with the measuring and cutting elements. This also makes it possible to detect faultily manufactured articles which can be removed from the production circuit before being inserted in the lighter, which would increase the cost of the items which would have to be rejected.

What I claim is:

1. A liquefied gas lighter comprising:

a body including a reservoir for liquefied gas;

an exhaust chimney in communication with said reservoir for receiving a flow of said gas from said reservoir;

flow shut off means comprising a lid member and a non-variable rate of flow limiter; and means for guiding the flow of gas from inside the reservoir to the flow shut off means;

said flow limiter and the means for guiding flow of gas comprising a single extruded plastic tube which is more than 5 mm long and which has at least one longitudinal passage with a total flow cross-section which is substantially constant along the length of said tube, wherein the sum of the areas of the flow cross-sections of all such passages is between 0.002 $mm^2$ and 0.03 $mm^2$, the tube being hermetically fit in the lighter body through the interposition of a support member.

2. A lighter according to claim 1, wherein at least one of the longitudinal passages has longitudinal surfaces which extend substantially opposite one another and which define narrow gaps for the flow of gas between one another.

3. A lighter according to claim 1 wherein the tube has a substantially cylindrical outside surface and an outside diameter of from 0.5 to 1 mm.

4. A lighter according to least one of claims 1 or 2 or 3 wherein the support member is made of a material which is a good heat conductor, the support member having a substantially dished prolongation which extends around the outside of a longitudinal part of the exhaust chimney, with the exhaust chimney having a reduced radial clearance between the prolongation and the exhaust chimney part.

5. A lighter according to any of claims 1 or 2 or 3 wherein the tube is made of a substance having a lipophobic behavior.

6. A liquified gas lighter according to claim 1, wherein said extruded plastic tube is formed by an extrusion process in which the tube is drawn cooled and cut to a required length, such that modifications to the dimensions of said longitudinal passages are not necessary.

7. A liquefied gas lighter comprising:

a body including a reservoir for liquefied gas;

an exhaust chimney in communication with said reservoir for receiving a flow of said gas from said reservoir;

flow shut off means comprising a lid member and a non-variable rate of flow limiter; and means for guiding the flow of gas from inside the reservoir to the flow shut off means;

said flow limiter and the means of guiding the flow of gas comprising a single extruded plastic tube which consists of a substance having a lipophobic behavior; said tube being ore than 5 mm long and having at least one longitudinal passage with a total flow cross-section in which the sum of the areas of the flow cross-sections of all such passages is between 0.002 $mm^2$ and 0.03 $mm^2$, the tube being hermetically fit in the lighter body through the interposition of a support member.

8. A lighter according to claim 7, wherein the flow cross-section of each longitudinal passage is substantially constant along the length of the tube.

9. A lighter according to claim 8, wherein at least one of the longitudinal passages has longitudinal surfaces which extend substantially opposite one another and which define narrow gaps for the flow of gas between one another.

10. A lighter according to claim 7, wherein the tube has a substantially cylindrical outside surface having a diameter of from 0.5 to 1 mm.

11. A lighter according to at least one of claims 7 to 10, wherein the support member is made of a material which is a good heat conductor, the support member having a substantially dished prolongation which extends around the outside of a longitudinal part of the exhaust chimney, the exhaust chimney having a reduced radial clearance between the prolongation and the exhaust chimney part.

12. A lighter according to claim 7, wherein said extruded plastic tube is formed by an extrusion process in which the tube is drawn, cooled and cut to a required length, such that modifications to the dimensions of said longitudinal passages are not necessary.

* * * * *